US007668492B2

(12) United States Patent
Kakehi

(10) Patent No.: US 7,668,492 B2
(45) Date of Patent: Feb. 23, 2010

(54) IMAGE FORMING APPARATUS FEATURING A ROTATABLE IMAGE CARRYING BELT AND A BELT ROTATION CONTROL UNIT FOR MINIMIZING CURLING OF THE BELT

(75) Inventor: Yutaka Kakehi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 11/670,506

(22) Filed: Feb. 2, 2007

(65) Prior Publication Data

US 2007/0183818 A1 Aug. 9, 2007

(30) Foreign Application Priority Data

Feb. 6, 2006 (JP) ..... 2006-028051

(51) Int. Cl.
*G03G 15/16* (2006.01)

(52) U.S. Cl. ..... 399/302

(58) Field of Classification Search ..... 399/302, 399/308, 312, 306
See application file for complete search history.

(56) References Cited

U.S. PATENT DOCUMENTS 6,868,248 B2 * 3/2005 Fukao et al. ..... 399/301
2004/1012731 7/2004 Takuroh, et al. ..... 474/117

FOREIGN PATENT DOCUMENTS

| | | | |
|---|---|---|---|
| JP | 9-222804 | A | 8/1997 |
| JP | 11-190965 | A | 7/1999 |
| JP | 2002-006585 | A | 1/2002 |
| JP | 2004-109706 | A | 4/2004 |

OTHER PUBLICATIONS

Computer translation of Japanese Publication No. 11-190965.
English-language translation of Japanese Publication No. 11-190965 A. Apr. 24, 2009.

* cited by examiner

*Primary Examiner*—Quana M Grainger
(74) *Attorney, Agent, or Firm*—Fitzpatrick, Cella, Harper & Scinto

(57) ABSTRACT

The present invention relates to an image forming apparatus, comprising: an image carrying belt which rotates so as to carry an image; a first roller supporting the image carrying belt; a second roller contacting a face opposite to a face of the image carrying belt contacting the first roller, and supporting the image carrying belt; and a control unit which controls rotation of the image carrying belt such that a portion of the image carrying belt, supported by the first roller in a period that the image carrying belt is stopped before image formation, is supported by the second roller in a period that the image carrying belt is stopped after the image formation.

5 Claims, 7 Drawing Sheets

IMAGE FORMING APPARATUS FEATURING A ROTATABLE IMAGE CARRYING BELT AND A BELT ROTATION CONTROL UNIT FOR MINIMIZING CURLING OF THE BELT

BACKGROUND OF THE INVENTION

1. Field of the Invention

The present invention relates to an image forming apparatus which records an image formed in an image forming unit onto a recording medium, including a belt which rotates while bearing toner images.

2. Description of the Related Art

Recently, a so-called intermediate transfer method has been known as a method to form color images in copying machines and printers using the electrophotographic technology. The method is so adapted that toner images formed on an image bearing member are primarily transferred to an intermediate transfer member while sequentially superimposed for respective colors, and then secondarily transferred to a recording medium collectively. In the method, a configuration using an intermediate transfer belt, formed of a belt, as an intermediate transfer member is widely adopted since the configuration includes such advantages as high freedom in arrangement and high adaptability to various media.

As a configuration utilizing high freedom in arrangement which is an advantage of the intermediate transfer belt method, a configuration including an inner roller arranged from the inside of an intermediate transfer belt and an outer roller pressing the belt from the outside of the intermediate transfer belt has been used (Japanese Patent Application Laid-Open No. 9-222804).

By using an outer roller in this way, the extra space inside the intermediate transfer belt can be made as small as possible, whereby the space for the main body of the apparatus can also be made small.

However, in the case of using an intermediate transfer belt, although there is no problem when the intermediate transfer belt is driven, when the belt is stopped, the tension of the belt concentrates on the roller part. If time passes in this state, a step made by the fact that the intermediate transfer belt is pushed along the shape of the roller, that is, a so-called curling habit, is caused. If image formation is performed by driving the intermediate transfer belt with a curling habit, defective images such as color shift may be caused due to vibration caused when driving.

SUMMARY OF THE INVENTION

An object of the present invention is to reduce defective images caused by curling habits of a belt.

Further, another object of the present invention is to provide an image forming apparatus including: an image carrying belt which rotates so as to carry images; a first roller supporting the image carrying belt; a second roller contacting a face opposite to a face of the image carrying belt contacting the first roller, and supporting the image carrying belt; and a control unit which controls rotation of the image carrying belt such that a portion of the image carrying belt, supported by the first roller in a period that the image carrying belt is stopped before image formation, is supported by the second roller in a period that the image carrying belt is stopped after image formation.

DETAILED DESCRIPTION OF THE PREFERRED EMBODIMENTS

Figure 1:
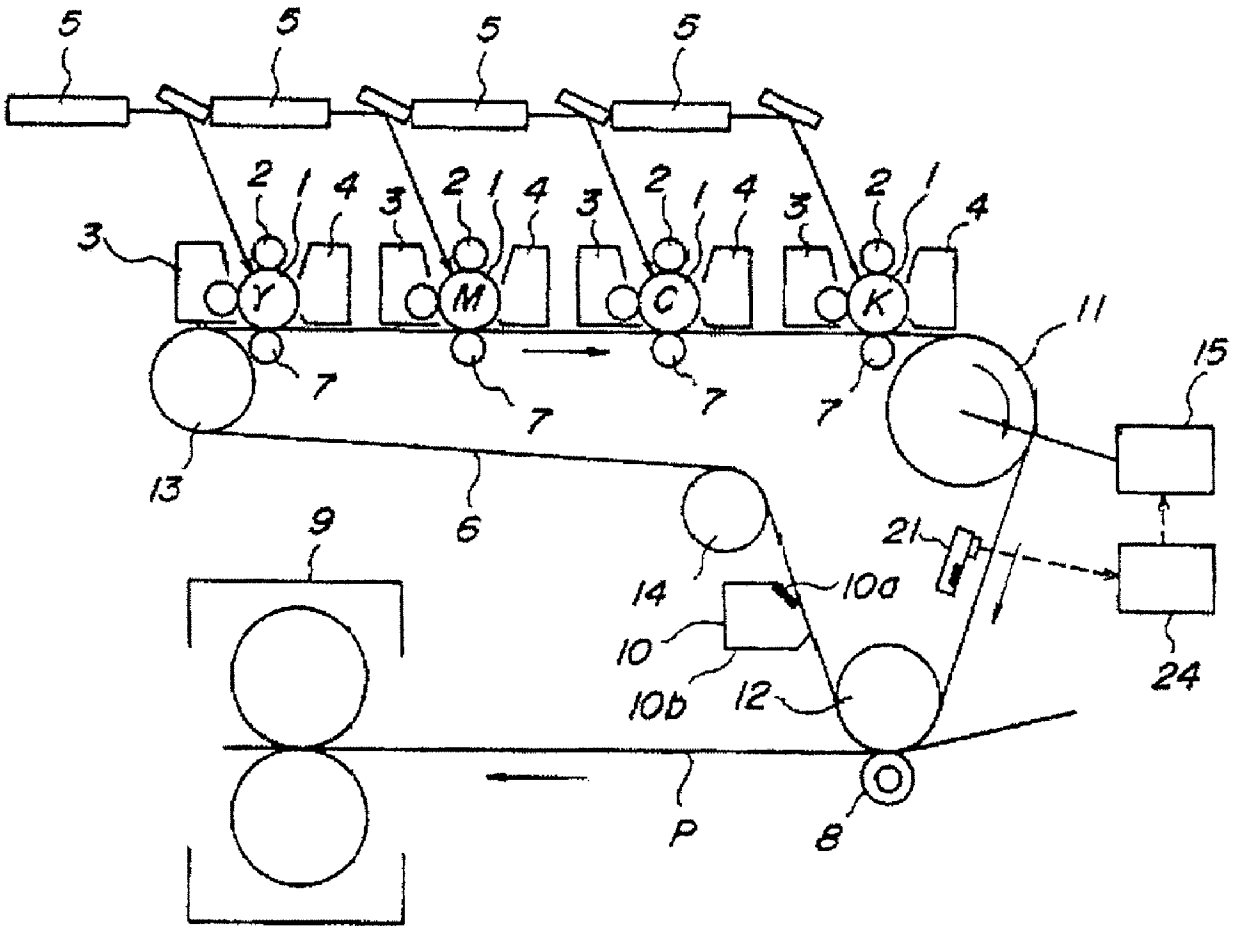
FIG. 1 is a diagram illustrating the overview of an image forming apparatus of a first embodiment.

An image forming apparatus according to an embodiment of the present invention will be described by referring to the drawings.

First Embodiment

Figure 2:
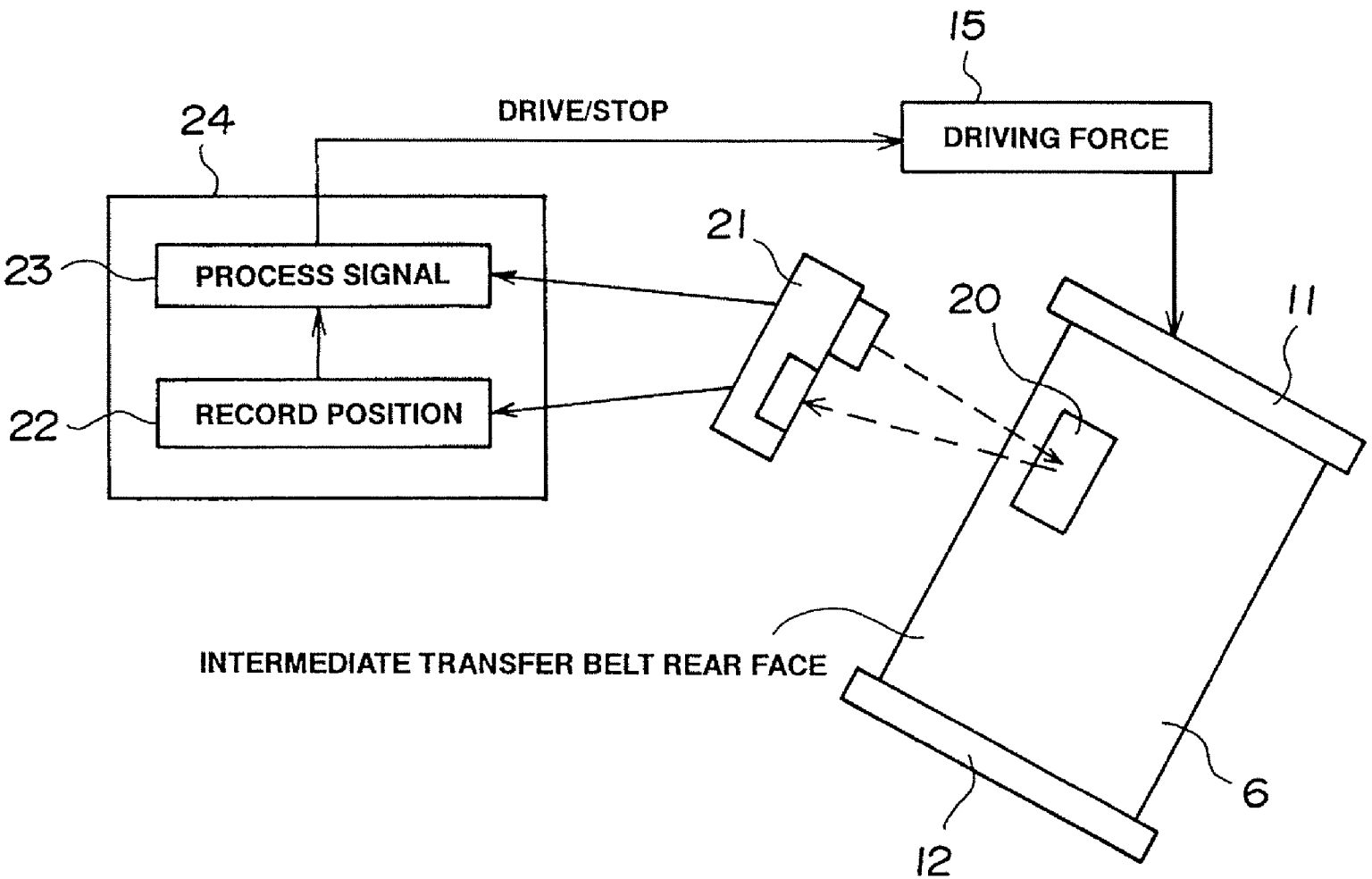
FIG. 2 is a diagram illustrating a mechanism for controlling the position of an intermediate transfer belt according to the first embodiment.
Figure 3A:
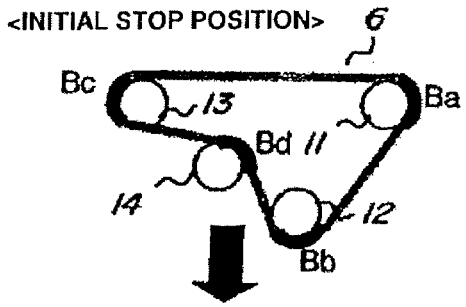
FIGS. 3A to 3C are diagrams illustrating a control of a stopped position of the intermediate transfer belt.
Figure 3B:
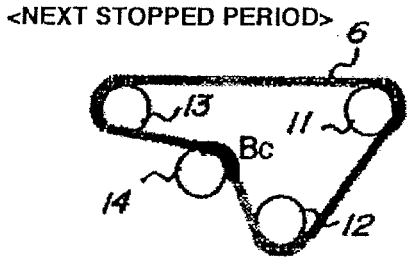

An image forming apparatus of a first embodiment according to the present invention will be described by using FIGS. 1 to 3. FIG. 1 is an overall schematic illustration of the image forming apparatus, and FIG. 2 is an illustration of a position detection unit of an endless belt. FIGS. 3 to 5 are illustrations of configurations to correct a curling habit of the endless belt.

[Overall Configuration of Image Forming Apparatus]

First, the overall configuration of the image forming apparatus will be described in brief together with an image forming operation by referring to FIG. 1. The image forming apparatus of the present embodiment forms color images using an electrophotographic operation.

An image forming unit includes four image forming stations arranged almost horizontally. In FIG. 1, the image forming stations, each of which forms a toner image of each color, that is, yellow Y, magenta M, cyan C or black K, are arranged from the left. Each image forming station has the same configuration except for the toner color.

In each image forming station, a primary charger 2, a developing device 3 and a cleaning device 4 are arranged around a photosensitive drum 1. Further, a scanner unit 5 which emits a laser beam corresponding to an image signal is arranged above the photosensitive drum 1.

Further, an intermediate transfer belt 6 which is an endless belt (image carrying belt) is provided rotatably so as to contact the photosensitive drum 1, and a primary transfer roller 7 is provided at a position opposite to the photosensitive drum 1 over the intermediate transfer belt 6.

In forming an image, the surface of the photosensitive drum 1 rotating in a counterclockwise direction in FIG. 1 is charged uniformly by the primary charger 2, and a laser beam corresponding to an image signal is emitted from the scanner unit 5. Thereby, an electrostatic latent image is formed. The latent image is developed with the toner by the developing device 3 so as to be made into a visible image.

By applying bias to the primary transfer roller 7, the toner image is primarily transferred to the intermediate transfer belt 6. Toner images of the respective colors, that is, yellow, magenta, cyan and black, formed by the respective image forming stations are transferred in a superimposing manner to the intermediate transfer belt 6, whereby a color image is formed. Then, the intermediate transfer belt 6 carries the toner image. By applying bias to the secondary transfer roller 8 in a secondary transfer portion serving as an image recording unit, the color image is secondarily transferred to and recorded on a recording medium P which is to be carried by a recording medium carrying unit (not shown).

The recording medium, to which the toner image is transferred, is guided by a fixing device 9, and after being fixed on a sheet P with heat and pressure applied, the toner image is ejected to the outside of the apparatus.

On the other hand, the surface of the intermediate transfer belt 6 which has finished transferring the toner image to the record medium P is cleaned by an intermediate transfer member cleaning device 10. The intermediate transfer member cleaning device 10 is so configured that a cleaning blade 10*a* made of urethane rubber is made to contact the surface of the intermediate transfer belt 6 so as to scrape the residual secondary transfer toner left on the surface of the intermediate transfer belt 6, and to collect it in a waste toner box 10*b*. The intermediate transfer belt 6 in which the residual secondary transfer toner has been scraped is stopped when the image formation ends. Then, when image formation is restarted, the intermediate transfer belt 6 rotates. During the time that image formation is not carried out, the intermediate transfer belt 6 is stopped.

[Winding Configuration of Intermediate Transfer Belt]

The image forming apparatus of the present embodiment is provided with a deformation correcting unit for removing a curling habit of the intermediate transfer belt 6. Next, the configuration thereof will be described.

For the intermediate transfer belt 6 used in the present embodiment, one having a volume resistivity of 106 to 1012 Ω/cm can be used. As the material thereof, one of urethane resin, fluorocarbon resin, nylon resin, polyimide resin, and an elastic material such as silicone rubber or hydrin rubber can be used. A material in which resistance adjustment is performed by dispersing carbon or conductive powder in any of the above materials can also be used. The intermediate transfer belt 6 is in a dark color since carbon is dispersed therein, having a thickness of 85 μm, a peripheral length of 900 mm and a width of 350 mm, and rotates in a clockwise direction in FIG. 1.

The intermediate transfer belt 6 winds on three inner rollers (first rollers) supporting and pressing the inside of the endless belt, and on one outer roller pressing the outside of the endless belt. The inner rollers contact the inner peripheral face of the intermediate transfer belt 6, and support the intermediate transfer belt 6. The inner rollers include a driving roller 11, a separating roller 12 and a supporting roller 13, with which the winding of the intermediate transfer belt 6 is supported from the inside thereof. The driving roller 11 is linked with a driving unit 15 which generates power to drive the intermediate transfer belt 6 by a motor, and drives the intermediate transfer belt 6 in a rotating direction R1. The separating roller 12 is grounded.

The outer roller (second roller, bending member) 14, serving as an inverse bending unit, is arranged outside the intermediate transfer belt 6. The outer roller 14 gives tension to the intermediate transfer belt 6 by pressing the intermediate transfer belt 6 so as to make it curve inwardly which is opposite to the curving direction of the belt wound on the three inner rollers 11, 12 and 13. Namely, the outer roller 14 bends the intermediate transfer belt 6 from the outer peripheral face to the inner peripheral face. The tension can be so set that the extension rate becomes not more than 1% such that the intermediate transfer belt 6 will not be broken or permanently distorted, although it depends on the material of the intermediate transfer belt 6. In the present embodiment, the intermediate transfer belt 6 made of polyimide resin is used, and is set to be applied with a load of 15 kgf.

Each of the inner rollers 11, 12 and 13 and the outer roller 14 of the present embodiment is a stainless roller having an outer diameter of 30 mm and a width of 340 mm. Especially, in the outer roller 14, mirror processing is performed so as not to damage the surface of the intermediate transfer belt 6.

The outer roller 14 is arranged at a position which is downstream in a belt rotating direction from a secondary transfer portion where a toner image is transferred from the intermediate transfer belt 6 to the recording medium P but in the upstream from a primary transfer portion where a toner image is transferred from the photosensitive drum 1 to the intermediate transfer belt 6. Namely, the outer roller 14 contacts the outer face side of the intermediate transfer belt 6, but it contacts at a part where the intermediate transfer belt 6 does not bear a toner image, so it will not contact a toner image. Therefore, the outer roller 14 will not be tainted by the toner, and a toner image on the intermediate transfer belt 6 will not be disrupted by a belt pressure roller 1.

[Belt Position Detecting Configuration]

The image forming apparatus of the present embodiment has a position detection unit which detects the position in a rotating direction of the intermediate transfer belt 6. As shown in FIG. 2, the position detection unit is so configured that a position detection mark 20, which is a white sticker having a smooth surface and high reflectivity, is put on the rear side of the intermediate transfer belt 6. The position detection mark 20 may be only one, but if there are two, speed and accuracy of detecting the position can be improved. In such a case, one mark 20 is put on one end side in a width direction of the intermediate transfer belt 6 from the rear side. The other mark 20 can be put on a position which is the other end side in the width direction of the intermediate transfer belt 6 and where the intermediate transfer belt 6 advances half around in a rotating direction, from the rear side.

Further, a position detection unit 21 is also provided, incorporating a light emitting element which emits light to the rear side of the intermediate transfer belt 6, and a light receiving element capable of receiving reflected light when the light caused by the light emitting element is emitted to and reflected at the rear side of the intermediate transfer belt 6. In this case, an LED is used as the light emitting element, and a photodiode is used as the light receiving element.

When the part with the position detection mark 20 comes to the position opposite to the position detection unit 21 due to the rotation of the intermediate transfer belt 6, the reflected light quantity of the part becomes larger when the part is irradiated since only the part is white. Thereby, the position can be detected.

Further, the image forming apparatus of the present invention has a memory as a position storing unit 22 for storing the position of the intermediate transfer belt 6. Moreover, the apparatus has a control circuit 24 incorporating a CPU as a position control unit 23 which processes information in the position detection unit 21 and the position storing unit 22 so as to be able to drive and stop the driving roller 11.

[Curling Habit Correcting Configuration of Intermediate Transfer Belt]

The image forming apparatus of the present embodiment is so configured as to be able to correct a curling habit of the intermediate transfer belt 6 by the position detection unit 21 and the position control unit 23. Next, the configuration thereof will be described by referring to FIGS. 3 to 5.

In order to correct a curling habit of the intermediate transfer belt 6, the initial stop position of the intermediate transfer belt 6 is detected by the procedures shown in the flowchart of FIG. 4 to thereby control the rotation of the belt.

Namely, when image forming operation starts, the intermediate transfer belt 6 starts rotating from the stopped state (step S1). At this time, the time period until the position detection mark 20 put on the rear face of the intermediate transfer belt 6 comes to the position of the position detection unit 21 is measured (step S2). Then, from the time period until the position detection mark 20 reaches the position of the position detection unit (mark detection unit) 21 of the intermediate transfer belt 6 and from the process speed, the portion where a curling habit is placed on the intermediate transfer belt 6 is detected (step S3). Specifically, as shown in FIG. 3A, positions Ba, Bb and Bc where the belt wound on the three inner roller 11, 12 and 13 and a position Bd where the belt wound on the outer roller 14, in the initial stopped period, are detected and stored on the position detection unit 21.

When the image process ends (step S4), the intermediate transfer belt 6 is rotated continuously so as to cause any of the positions Ba, Bb and Bc of the intermediate transfer belt 6 come to the position of the outer roller 14 by the position control unit 23 on the control circuit 24 based on the information of the position storing unit 22, and stopped (step S5, S6).

Figure 3C:
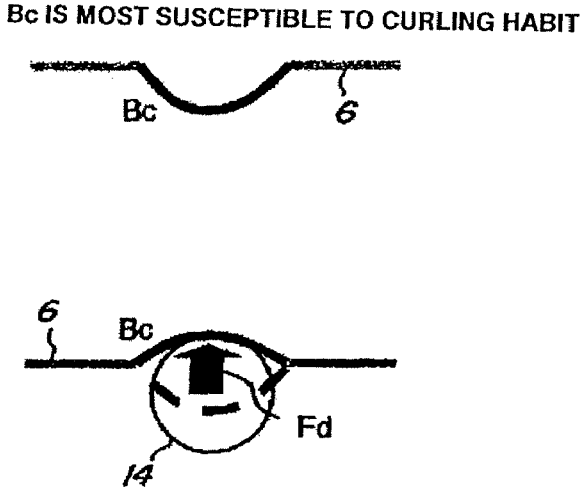
Figure 4:
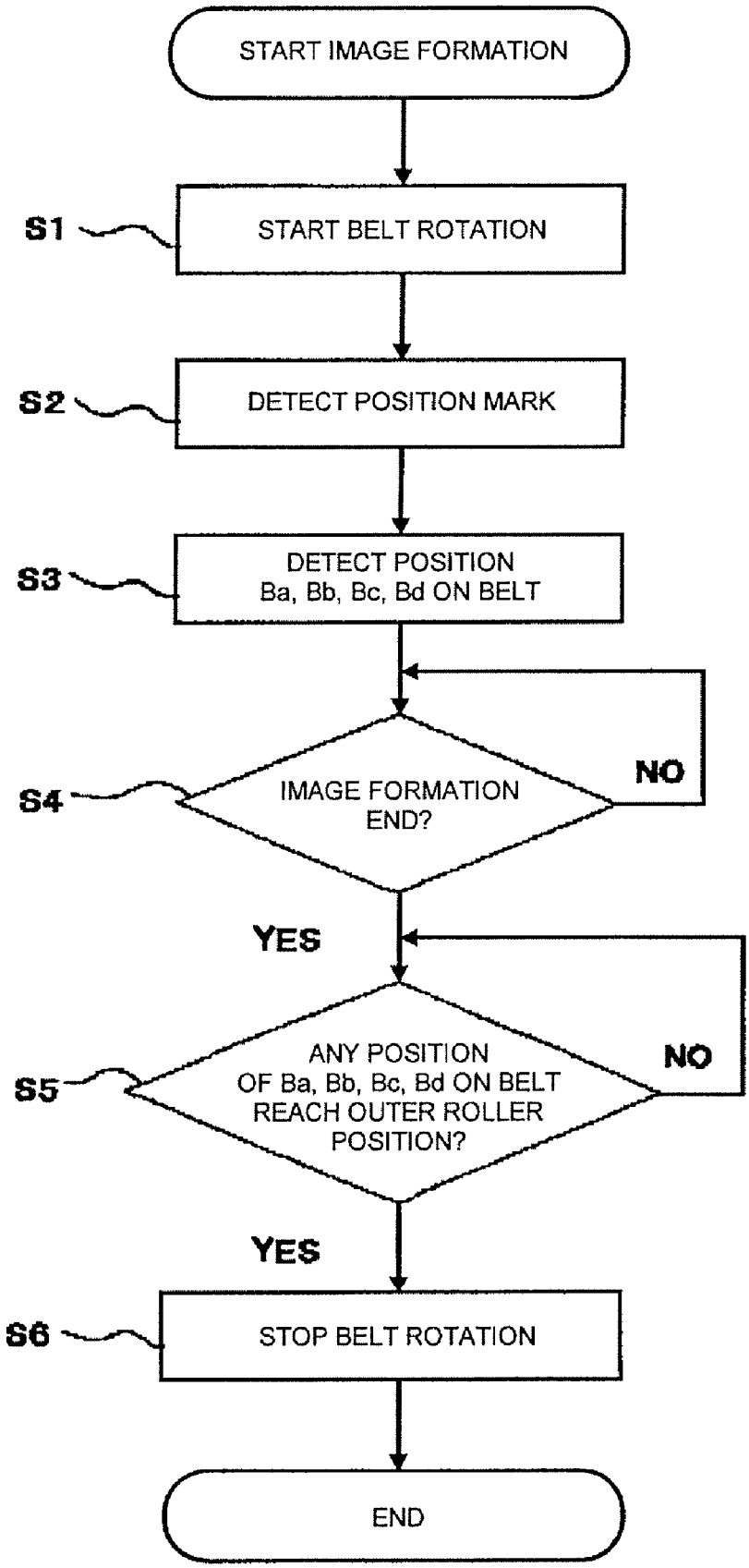
FIG. 4 is a flowchart illustrating a control of a stopped position of the intermediate transfer belt.

Thereby, since the part with an outer convex curling habit (Bc in FIG. 3B) is stopped in a state of having an inner convex shape, the curling habit is corrected (refer to FIG. 3C). Accordingly, by performing such a driving control, any one of curling habits caused in the stopped period of the intermediate transfer belt 6 can be corrected.

Figure 5A:
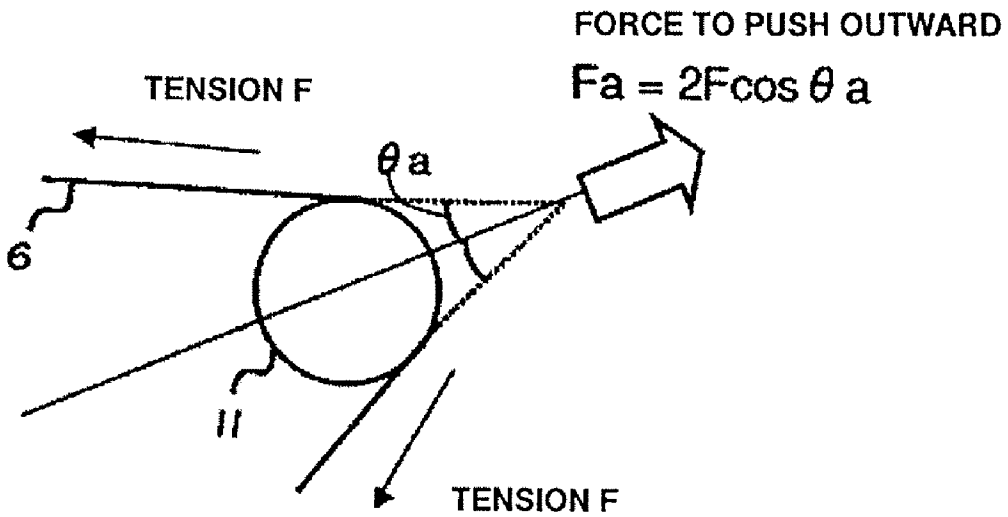
FIGS. 5A and 5B are diagrams illustrating the intensity of a force pushing out the intermediate transfer belt outward by the inner roller.
Figure 5B:
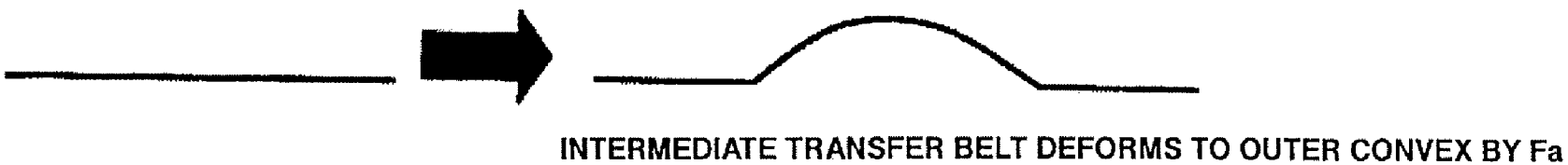

Now, a method of correcting a curling habit more effectively will be described. As shown in FIGS. 5A and 5B, a force to push the intermediate transfer belt 6 outward by the inner rollers 11, 12 and 13 in the stopped period will be considered by taking the inner roller 11 as an example.

In this case, as shown in FIG. 5A, the intermediate transfer belt 6 is applied with tension F in two directions by the inner roller 11 with a bending angle 2θa. In such a case, a force Fa to strain the intermediate transfer belt 6 outward becomes 2F cos θa at the center of the inner roller 11. In other words, the force to push the intermediate transfer belt 6 outward by the inner roller becomes larger as the core angle 2θa defined by the two lines of the intermediate transfer belt 6 contacting the inner roller 11 is smaller, whereby a curling habit is placed on easily (refer to FIG. 5B).

Among the three inner rollers 11, 12 and 13, the supporting roller 13 is the one in which the force to push outward in the stopped period is easily concentrated so as to cause a curling habit most easily, in the example of FIG. 1. The position Bc where the intermediate transfer belt 6 winds on the support roller 13 is stored on the position storing unit 21.

After the initial stop position is stored, the image forming process is performed by the method described above. Even after the image forming process ends, the intermediate transfer belt 6 is rotated. Then, the intermediate transfer belt 6 is stopped when the position Bc, where the belt contacted the support roller 13 with the largest curvature of the intermediate transfer belt 6 in the stopped period, comes to the position of the outer roller 14, by the position control unit 23 on the control circuit 24 based on the information of the position storing unit 21.

As described above, the belt driving unit 15 is operated to thereby control the static position of the intermediate transfer belt 6. Thereby, the outer convex curling habit, occurring in the stopped period, on the intermediate transfer belt 6 is pushed inward by the outer roller 14 and corrected. Thereby, defective images such as color shift and uneven transfer due to the curling habit can be prevented.

Second Embodiment

Figure 6:
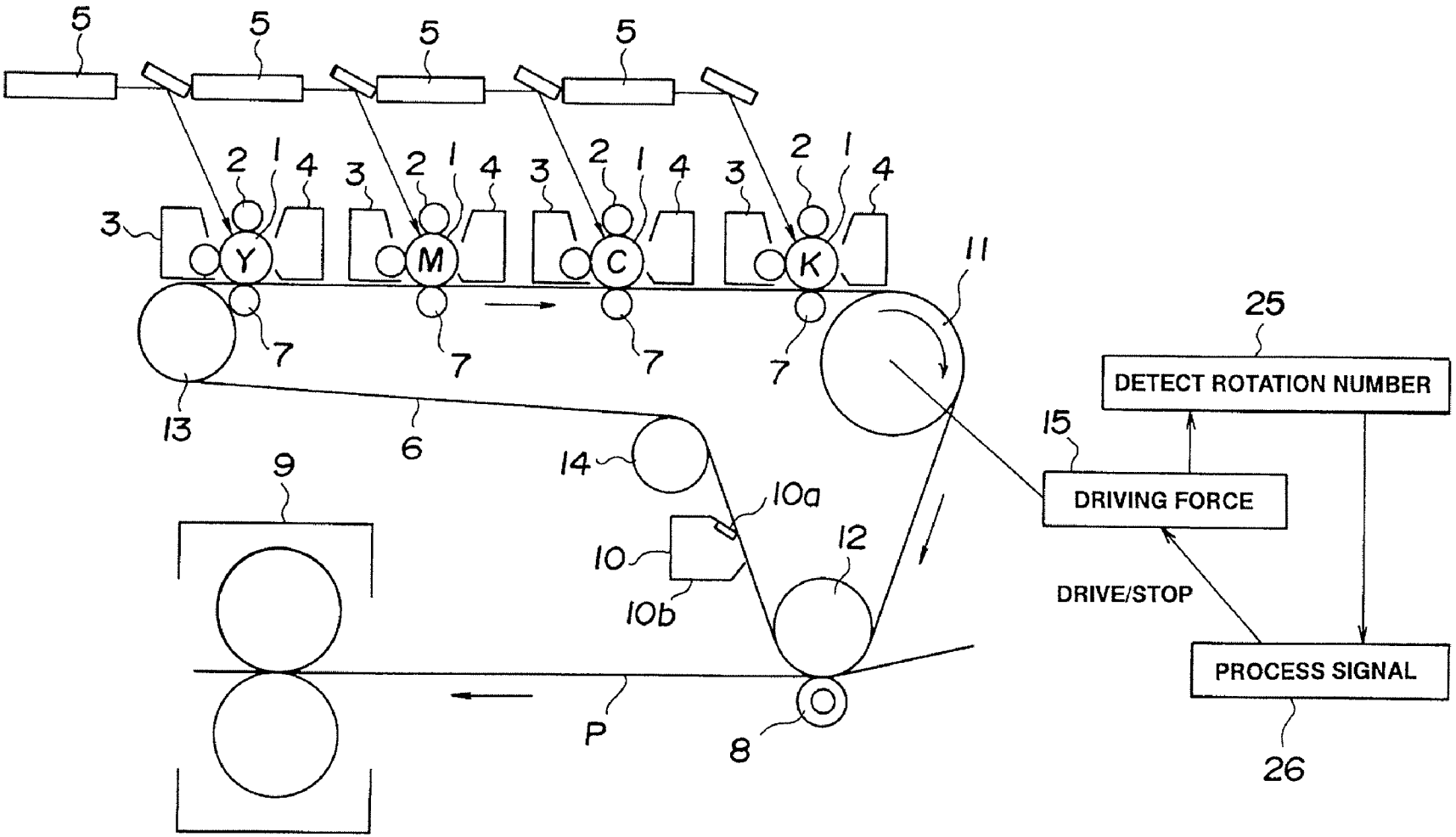
FIG. 6 is a diagram illustrating the overview of an image forming apparatus of a second embodiment.

Next, an image forming apparatus according to a second embodiment will be described by referring to FIG. 6. Note that the basic configuration of the apparatus of the present embodiment is same as that of the previous embodiment. Therefore, a redundant description thereof will not be provided, and characteristic configuration of the present embodiment will be described here. Further, members having the same functions as those of the above embodiment are denoted by the same reference numerals.

In the first embodiment described above, the rotating position of the intermediate transfer belt 6 is determined and controlled by the position detection mark 20 and the position control unit 24. The present embodiment is so configured that the rotating position of the intermediate transfer belt 6 is determined and controlled by the configuration described below.

The belt driving unit 15 applying a driving force to rotate the intermediate transfer belt 6 in a rotating direction generates power by the force of the motor. Therefore, the number of rotations of the motor and the distance that the intermediate transfer belt 6 moves in a rotating direction are in a proportional relationship, and the number of rotations of the motor has a proportional relationship with the time period that the motor rotates. By using this, for the period from the time that the intermediate transfer belt 6 starts moving so as to start the image process until the time that the image process ends and the belt is stopped, the number of rotations of the belt driving unit 15 is calculated from the time period that the motor of the belt driving unit 15 operates, as shown in FIG. 6. Thereby, based on the rotation number detection unit 25 obtaining the number of rotations of the intermediate transfer belt 6 and on the information obtained from the rotation number detection unit 25, the distance that the intermediate transfer belt 6 has moved from the initial stop position is calculated. Then, the rotation number control unit 26 which drives and stops the belt driving unit 15 determines the rotating position of the intermediate transfer belt 6 and performs a driving control.

Then, any one of the positions Ba, Bb and Bc in the rotating direction of the intermediate transfer belt 6 contacting the inner rollers 11, 12 and 13 in the stopped period, shown in FIGS. 3A and 3B, is caused to stop at the position of the outer roller 14 by the position control unit 23 based on the information of the position storing unit 21 after the image process. By such a control, any one of the curling habits caused in the intermediate transfer belt 6 in the stopped period can be corrected.

Further, by making the belt position Bc, contacting the supporting roller 13 causing a curling habit most easily among the inner rollers 11, 12 and 13 in the initial stopped period, stop at the position contacting the outer roller 14 at the next stopped period same as the case of first embodiment, the curling habit can be corrected more effectively.

Third Embodiment

The previous embodiments have described image forming apparatuses of an intermediate transfer method in which a toner image formed on an image bearing member is primarily transferred to the intermediate transfer belt, and the primarily transferred image is secondarily transferred to a recording medium to thereby form an image. However, the curling habit correcting configuration of an endless belt described above can be applied in the same manner to a belt other than an intermediate transfer belt.

Figure 7:
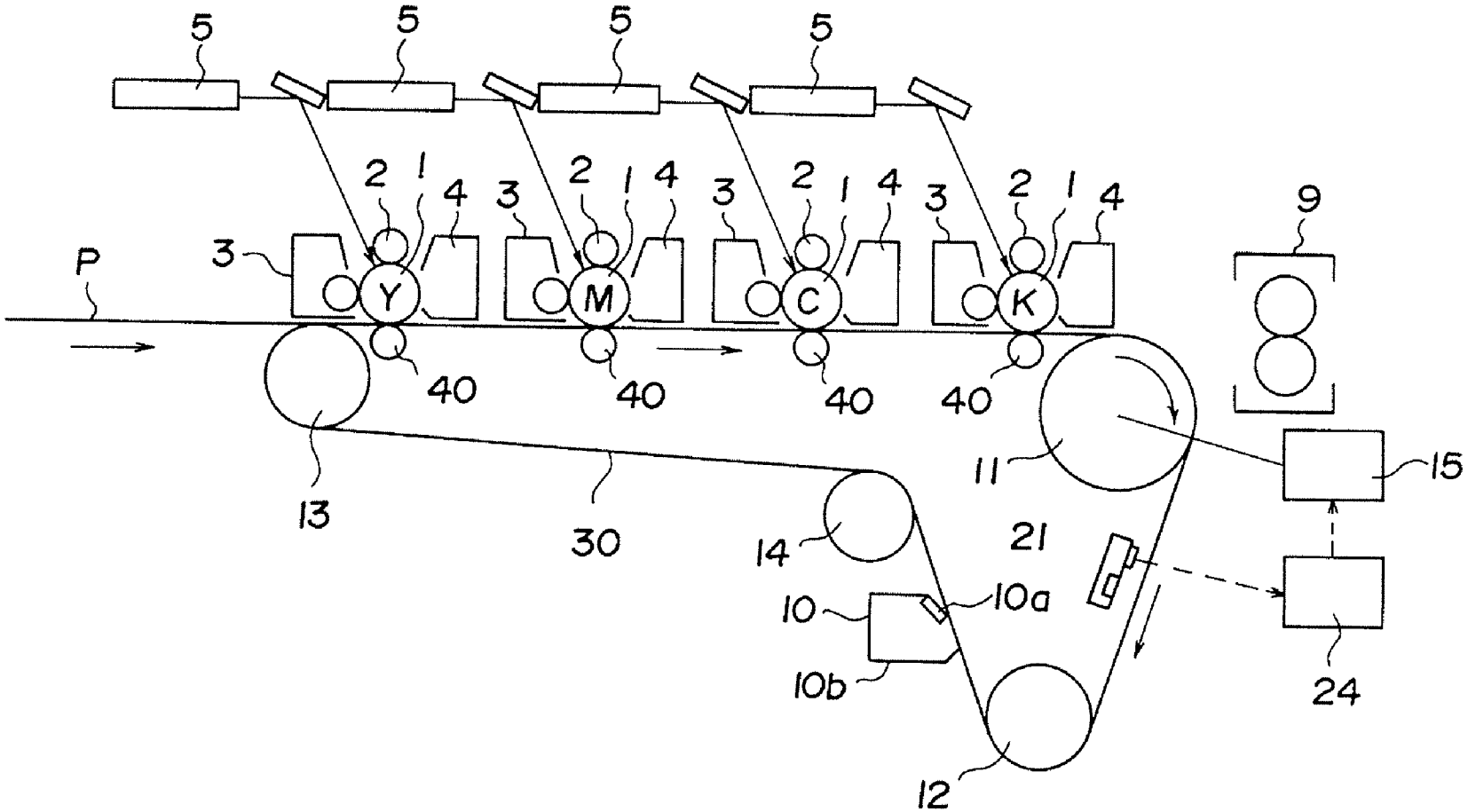
FIG. 7 is a diagram illustrating the overview of an image forming apparatus of a third embodiment.

FIG. 7 shows an image forming apparatus having a carrying belt which carries a recording material as an endless belt. The members having the same constitutional actions as those of first and second embodiments 1 are denoted by the same reference numerals, and the description thereof is not repeated.

For instance, four photosensitive drums 1 forming toner images of the respective colors of yellow, magenta, cyan and black are arranged on a line, and along the photosensitive drums 1, a carrying belt 30 formed of an endless belt is arranged rotatably. A recording material P is adsorbed electrostatically to the rotating carrying belt 30, and carried to the yellow photosensitive drum 1 first. Then, a voltage of the opposite polarity to that of the toner image is applied to a transfer roller 40 provided opposite the photosensitive drum 1, whereby the yellow toner image on the photosensitive drum 1 is transferred to the recording material P. Similarly, toner images of magenta, cyan and black are transferred to the recording material P. The recording material P to which the toner images are transferred is fixed by the fixing device 9, whereby a permanent image is obtained. Even in the image forming apparatus of the present embodiment, the inside of the carrying belt 30 winds on a plurality of inner roller (11, 13, 12) and is supported by the inner roller. The outer roller 14 bends the carrying belt 30 from the outer peripheral face to the inner peripheral face so as to support the carrying belt 30.

Then, a driving control is performed such that any one portion (from effectiveness point, portion having the acutest bending angle), among the portions of the carrying belt 30 positioned at the plurality of inner rollers (11, 13, 12) in the stopped period before image formation, stops at the position of the outer roller 14 in the stopped period after image formation. Even in such a case, a curling habit of the carrying belt can be corrected, so defective images such as color shift due to curling habits of the belt can be reduced.

This application claims the benefit of priority from the prior Japanese Patent Application No. 2006-28051 filed on Feb. 6, 2006 the entire contents of which are incorporated by reference herein.

What is claimed is:

1. An image forming apparatus, comprising:

an image bearing member;

a rotatable belt member for carrying an image;

a transfer member having a transfer portion where a toner image is transferred from the image bearing member to the belt member;

a plurality of rollers contacting an inner surface of the belt member, and bending the belt member so as to suspend the belt member in a tensioned state;

an outer roller contacting an outer surface of the belt member, and bending the belt member so as to suspend the belt member in a tensioned state; and a control unit, wherein (i) the control unit controls an initial stopping of the belt member such that a plurality of contact portions are defined on the belt member where the belt member contacts the plurality of rollers, and (ii) after the rotation of the belt member is restarted, the control unit controls a subsequent stopping of the belt member such that at least one of the plurality of contact portions contacts the outer roller.

2. The image forming apparatus according to claim 1, further comprising a mark detection unit which detects a mark rotating together with the belt member, wherein the control unit controls the rotation of the belt member based on a detection result of the mark detection unit.

3. The image forming apparatus according to claim 1, further comprising a rotation number detection unit which detects a number of rotations of a driving roller which drives the belt member, wherein the control unit controls the rotation of the belt member based on a detection result of the rotation number detection unit.

4. The image forming apparatus according to claim 1, wherein the belt member is an intermediate transfer belt to which a toner image is transferred and from which the toner image is further transferred to a recording material.

5. The image forming apparatus according to claim 1, wherein the belt member is a carrying belt which carries a recording material.

* * * * *